US007936239B2

(12) United States Patent
Gopikrishnan Babu et al.

(10) Patent No.: US 7,936,239 B2
(45) Date of Patent: May 3, 2011

(54) BREAKER INTERLOCK SYSTEM AND METHOD

(75) Inventors: Triplicane Gopikrishnan Babu, Andra Pradesh (IN); Janakiraman Narayanan, Andra Pradesh (IN); Mahesh Jaywant Rane, Secunderabad (IN); Soundararajan Narayanasamy, Hyderabad (IN)

(73) Assignee: General Electric Company, Schenectady, NY (US)

( * ) Notice: Subject to any disclaimer, the term of this patent is extended or adjusted under 35 U.S.C. 154(b) by 475 days.

(21) Appl. No.: 12/103,093

(22) Filed: Apr. 15, 2008

(65) Prior Publication Data

US 2009/0256657 A1 Oct. 15, 2009

(51) Int. Cl.
*H01H 75/00* (2006.01)
*H01H 77/00* (2006.01)
*H01H 83/00* (2006.01)

(52) U.S. Cl. ..... 335/20; 335/14

(58) Field of Classification Search ..... 335/6, 8, 335/14, 20

See application file for complete search history.

(56) References Cited

U.S. PATENT DOCUMENTS

| | | | | | |
|---|---|---|---|---|---|
| 3,919,674 | A | * | 11/1975 | Acampora et al. | 335/20 |
| 4,000,478 | A | | 12/1976 | Jencks et al. | |
| 4,097,831 | A | * | 6/1978 | Jencks et al. | 335/166 |
| 4,178,572 | A | * | 12/1979 | Gaskill et al. | 335/14 |
| 4,409,572 | A | * | 10/1983 | Mostosi | 335/8 |
| 4,725,799 | A | * | 2/1988 | Bratkowski et al. | 335/14 |
| RE32,882 | E | * | 3/1989 | Yokoyama et al. | 335/14 |
| 4,855,698 | A | * | 8/1989 | Cohen et al. | 335/14 |
| 4,884,164 | A | | 11/1989 | Dziura et al. | |
| 5,164,693 | A | * | 11/1992 | Yokoyama et al. | 335/14 |
| 5,239,144 | A | | 8/1993 | Robbins et al. | |
| 5,381,119 | A | | 1/1995 | Robbins et al. | |
| 5,493,265 | A | * | 2/1996 | Whipple et al. | 335/202 |
| 5,508,670 | A | | 4/1996 | Mantzouridis et al. | |
| 5,519,367 | A | * | 5/1996 | Castonguay et al. | 335/14 |
| 5,534,833 | A | * | 7/1996 | Castonguay et al. | 335/68 |
| 5,740,003 | A | * | 4/1998 | Seymour et al. | 361/115 |
| 6,469,600 | B1 | * | 10/2002 | Seese et al. | 335/6 |
| 6,853,279 | B1 | * | 2/2005 | Puskar et al. | 335/172 |
| 7,405,640 | B2 | * | 7/2008 | McCoy | 335/6 |
| 2005/0001700 | A1 | * | 1/2005 | Lewis | 335/14 |

FOREIGN PATENT DOCUMENTS

| | | | |
|---|---|---|---|
| WO | 95/32512 | A2 | 11/1995 |
| WO | 9532512 | A1 | 11/1995 |

OTHER PUBLICATIONS

European Search Report; Application No. 09157234.7; Date of Mailing: Aug. 17, 2009. EP Search Report issued in connection with corresponding EP Patent Application No. 09157234 filed Apr. 2, 2009.

* cited by examiner

*Primary Examiner* — Elvin G Enad
*Assistant Examiner* — Alexander Talpalatskiy
(74) *Attorney, Agent, or Firm* — Global Patent Operation; Stephen G. Midgley

(57) ABSTRACT

Disclosed herein is a breaker interlock system. The system includes, a trip unit for a breaker, and a breaker receptive of the trip unit. The breaker is closable when the trip unit is assembled thereto and the breaker is non-closable when the trip unit is not assembled to the breaker. The interlock system is further configured to prevent disassembly of the trip unit from the breaker when the breaker is in a closed configuration. The breaker having a plurality of solenoids and each of the plurality of solenoids is in operable communication with the breaker to trip the breaker on command. A first of the plurality of solenoids is responsive to a signal from the breaker via the trip unit, and a second of the plurality of solenoids is responsive to an externally supplied signal from a source other than the electronic trip unit.

13 Claims, 8 Drawing Sheets

BREAKER INTERLOCK SYSTEM AND METHOD

BACKGROUND OF THE INVENTION

Circuit breakers provide a means for controlling supply of electrical power to a circuit, which may be a single-phase circuit, a three-phase circuit, or a multi-phase circuit with a switched neutral, for example. A trip unit, such as an electronic trip unit control module, is commonly used to interface with the breaker to control tripping characteristics such as, rate of tripping and trip current, for example. Trip units may be removable from the breaker for servicing and for replacement by trip units having alternate tripping characteristics. A breaker being in a closed configuration while the trip unit is removed from the breaker may be an undesirable condition since the circuit may not be trip protected without the trip unit being installed. The industry may, therefore, be desirous of a system to interlock the trip unit with the breaker.

BRIEF DESCRIPTION OF THE INVENTION

Disclosed herein is a breaker interlock system. The system includes, a trip unit for a circuit breaker, and a circuit breaker receptive of the trip unit. The circuit breaker is closable when the trip unit is assembled thereto and the circuit breaker is non-closable when the trip unit is not assembled to the circuit breaker. The interlock system is further configured to prevent disassembly of the trip unit from the circuit breaker when the circuit breaker is in a closed configuration. The circuit breaker having a plurality of solenoids and each of the plurality of solenoids is in operable communication with the circuit breaker to trip the circuit breaker on command. A first of the plurality of solenoids is responsive to a signal from the circuit breaker via the trip unit, and a second of the plurality of solenoids is responsive to an externally supplied signal from a source other than the electronic trip unit.

Further disclosed herein is a method of interlocking an electronic trip unit with a multi-phase circuit breaker. The method includes, enabling closure of the circuit breaker when the trip unit is assembled thereto, disabling closure of the circuit breaker when the trip unit is not assembled to the circuit breaker, lockingly engaging the trip unit in assembly with the circuit breaker when the circuit breaker is in a closed configuration, and enabling tripping of the multi-phase circuit breaker with a plurality of solenoids. A first of the plurality of solenoids is responsive to a signal from the circuit breaker via the trip unit, and a second of the plurality of solenoids is responsive to an externally supplied signal from a source other than the trip unit.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of one or more embodiments of the disclosed apparatus and method are presented herein by way of exemplification and not limitation with reference to the Figures.

Figure 1:
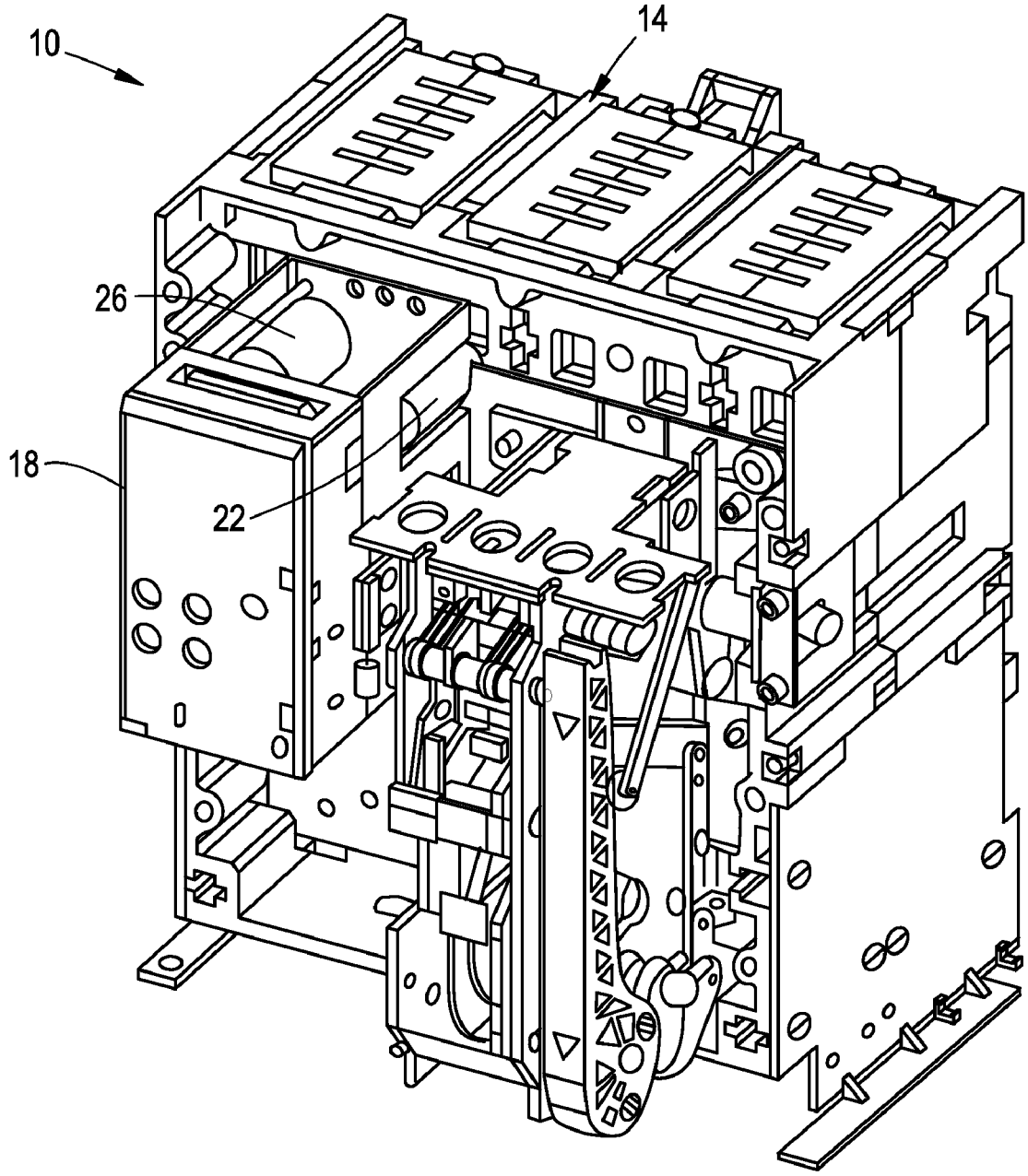
FIG. 1 depicts a perspective view of a breaker interlock system with a representative trip unit installed in accordance with an embodiment of the invention.

Referring to FIG. 1, an embodiment of a breaker interlock system 10 disclosed herein is illustrated. The breaker interlock system 10 includes, a breaker 14 and an electronic trip unit module 18 shown assembled thereto. The breaker 14 is configured to allow current to flow through a circuit (not shown) in response to being in a closed configuration and to prevent current from flowing through the circuit in response to the breaker 14 being in an open configuration. The breaker 14 includes a plurality of trip solenoids, with two trip solenoids 22, 26 being illustrated in this embodiment. The breaker 14 is configured so that if either of the two solenoids 22, 26 is energized the breaker 14 will trip thereby opening the circuit. The first trip solenoid 22 is configured to be energized via the trip unit 18 in response to a specified condition occurring in the circuit and being communicated to the trip unit 18, while the second trip solenoid 26 is configured to be energized in response to a control signal supplied from an external source, such as a secondary trip unit, an additional circuit monitoring system or an emergency shut off signal, for example.

The breaker 14 is configured such that the breaker 14 is not closable when the trip unit 18 is not assembled thereto and, conversely, is closable when the trip unit is assembled thereto. Additionally, the trip unit 18 is interlockable with the breaker 14 such that the trip unit 18 cannot be disassembled from the breaker 14 when the breaker 14 is in a closed configuration. The mechanics that control these interlocking relationships will be discussed in detail below.

Figure 2:
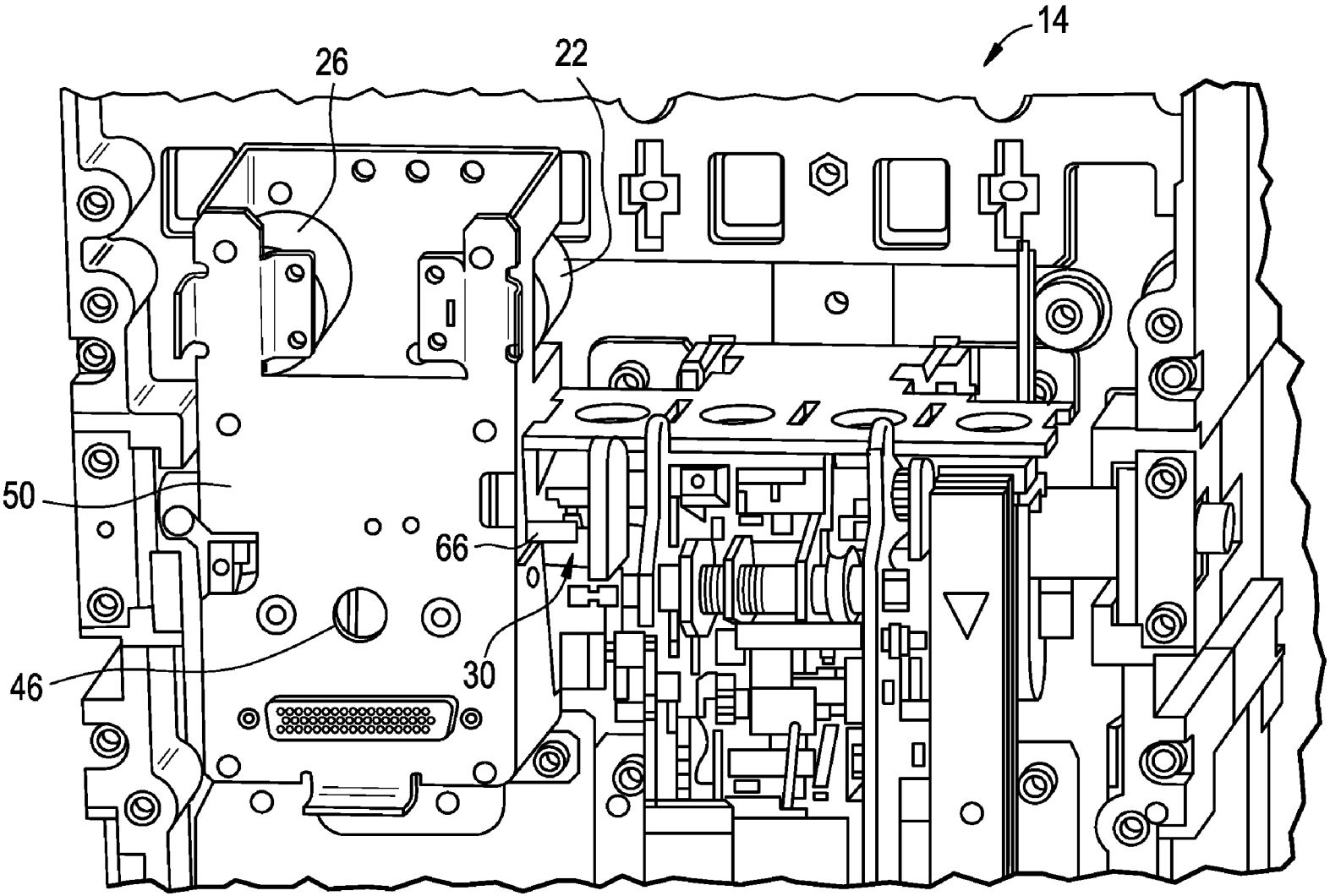
FIG. 2 depicts a magnified perspective view of the breaker interlock system of FIG. 1 with the trip unit removed.
Figure 3:
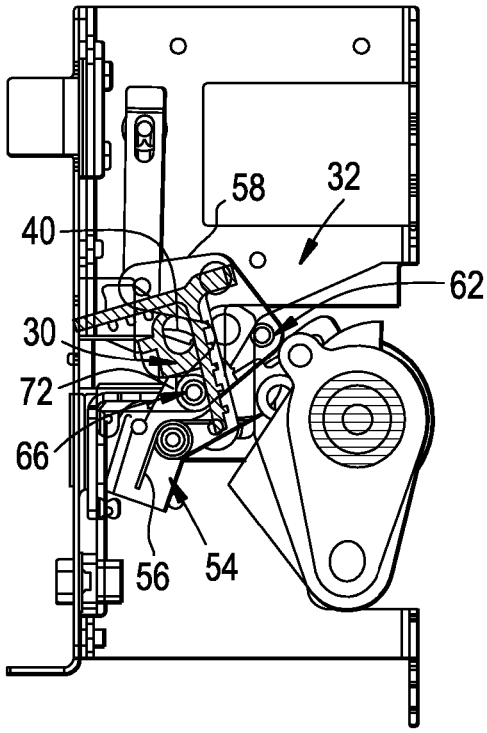
FIG. 3 depicts a partial side view of a breaker of FIG. 1 shown with the trip unit removed.
Figure 4:
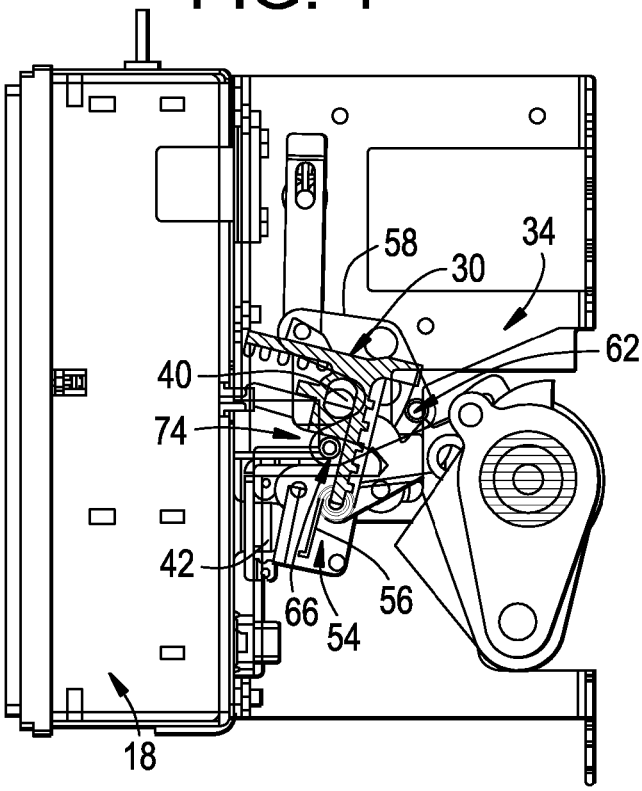
FIG. 4 depicts a partial side view of the breaker of FIG. 3 with the trip unit installed.
Figure 5:
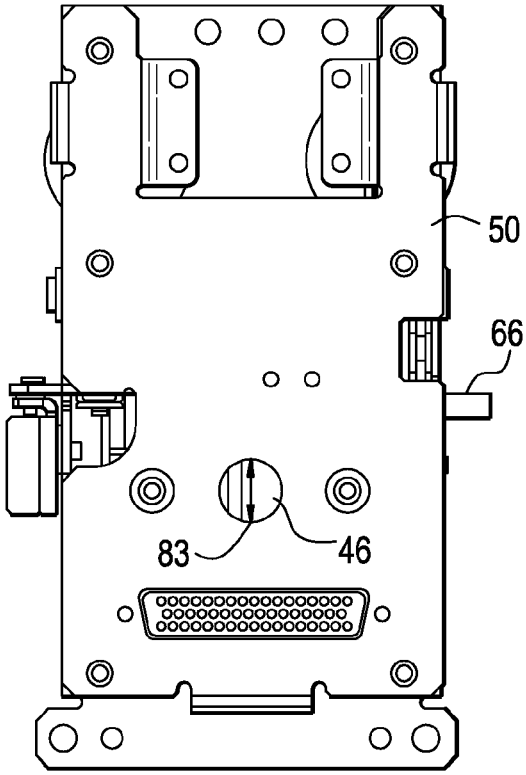
FIG. 5 depicts a partial plan view of the breaker of FIG. 2 with the trip unit removed.
Figure 6:
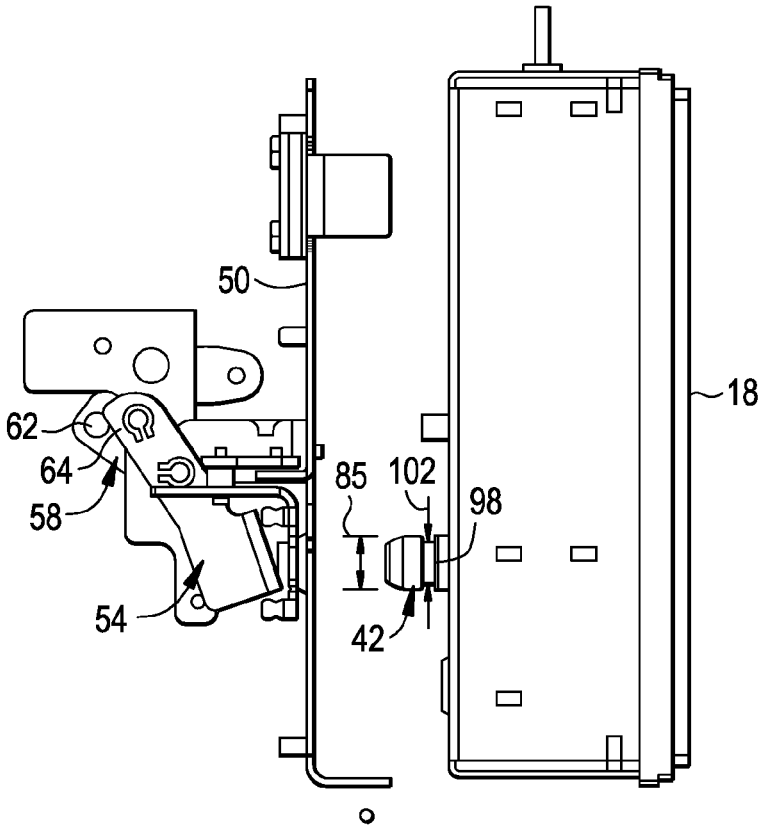
FIG. 6 depicts a partial side view of the breaker of FIG. 5 with the trip unit shown prior to installation.
Figure 7:
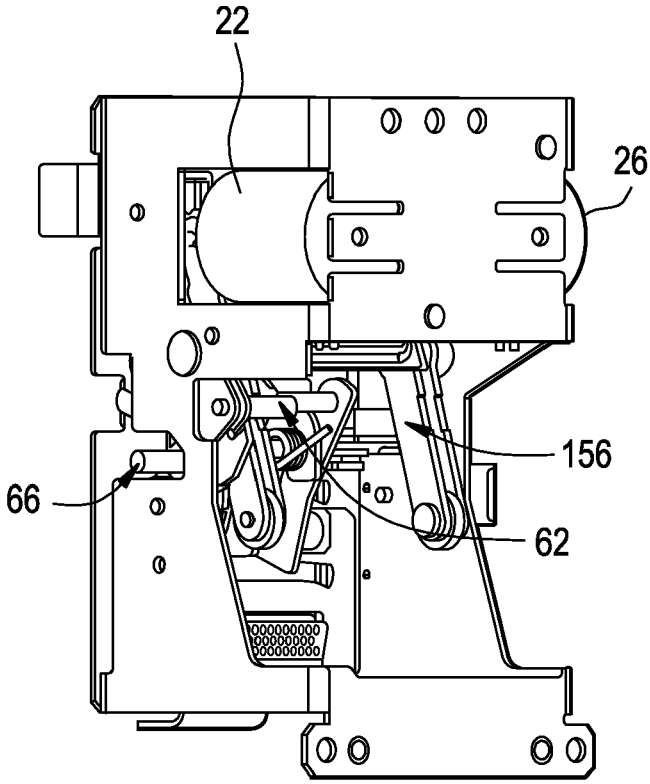
FIG. 7 depicts a partial perspective view of the breaker of FIG. 5 with the trip unit removed.
Figure 8:
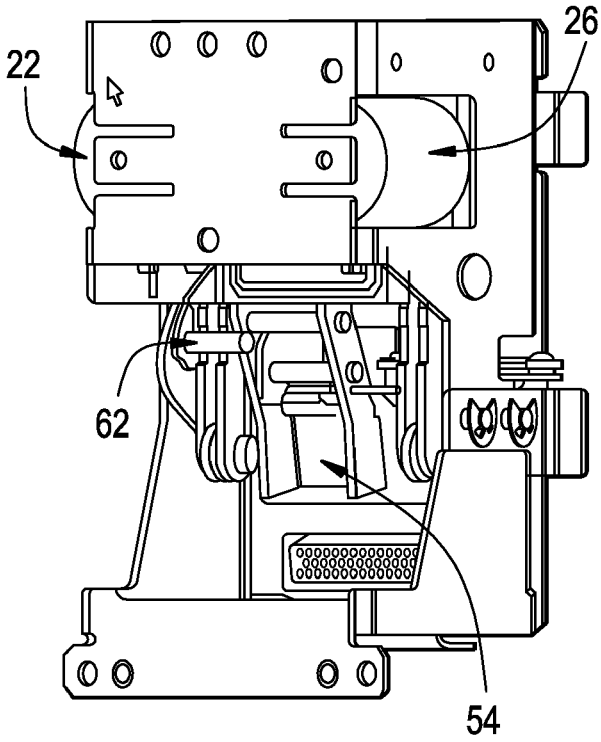
FIG. 8 depicts a partial perspective view of the breaker of FIG. 7 from a different angle.

Referring to FIGS. 2, 3 and 4, the breaker 14 has a trip paddle 30 that is movable between a first paddle position 32 (shown in FIG. 3) and a second paddle position 34 (shown in FIG. 4). The breaker 14 is configured to be closable when the trip paddle 30 is in the second paddle position 34 and is not closable when the trip paddle 30 is in the first paddle position 32. A biasing member (not shown), such as a torsion spring, biases the trip paddle 30 toward the second paddle position 34. The trip paddle 30 is, however, maintained in the first paddle position 32 until allowed to move in response to action of the biasing member. The trip paddle 30 moves from the first paddle position 32 to the second paddle position 34 about paddle pivot 40 in response to a number of linkages moving as the trip unit 18 is installed to the breaker 14, as will be described next.

Figure 9:
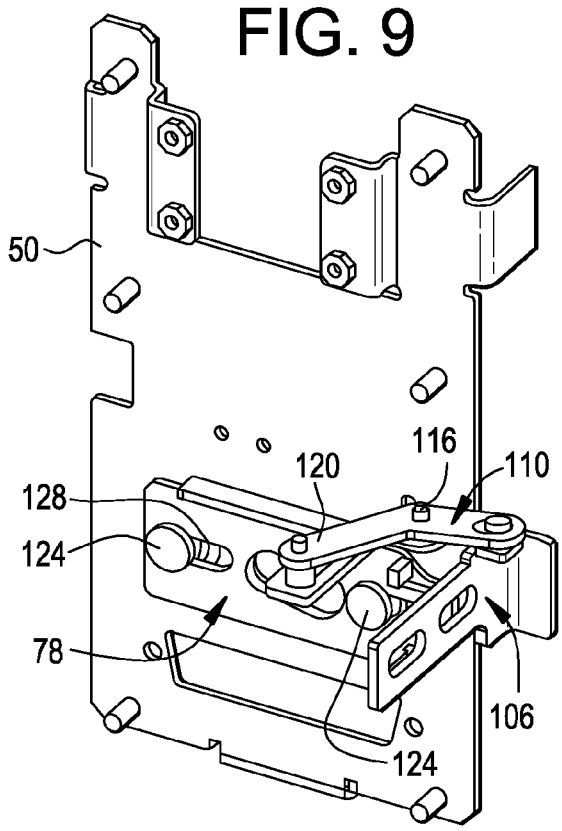
FIG. 9 depicts a partial perspective view of a back side of a plate of the breaker of FIG. 8 with some of the components removed.
Figure 10A:
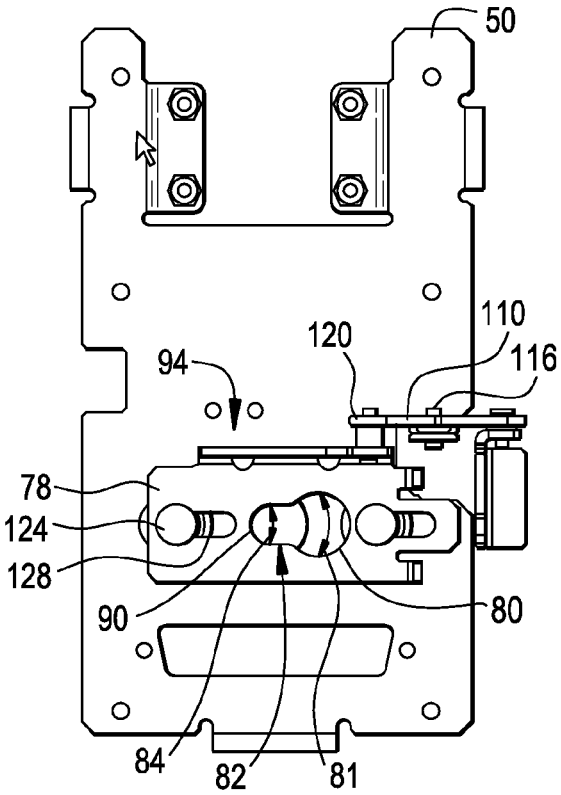
FIGS. 10A and 10B depict partial plan views of the plate of FIG. 9 in two alternate configurations.
Figure 10B:
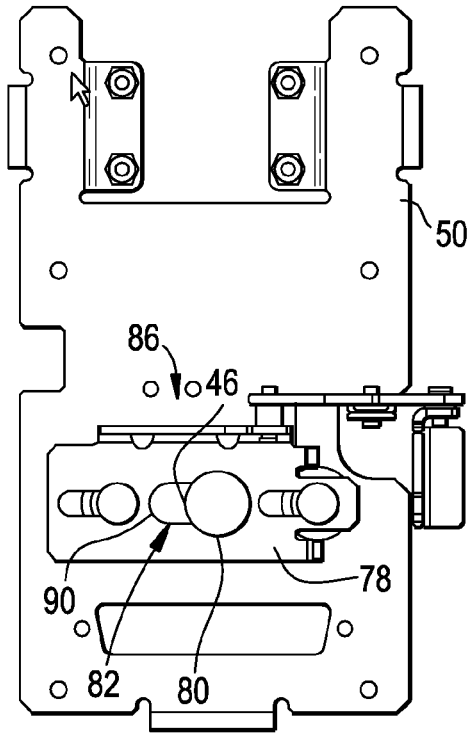

Referring to FIGS. 5-8 in addition to FIGS. 3 and 4, a lock pin 42 protruding from the trip unit 18 travels through hole 46 in plate 50 of the breaker 14 as the trip unit 18 is installed to the breaker 14 (Note: button 106 of the breaker 14 must be in a pressed configuration before the lock pin 42 can be inserted through the hole 46 as will be described in detail with reference to FIGS. 9-11 below). During such installation, the lock pin 42 makes contact with a trip arm 54, which is rotationally biased by a biasing member 56, shown herein as a torsion spring, thereby biasing the trip arm 54 in a rotational direction that is clockwise as viewed in FIGS. 3, 4 and 7 and counterclockwise as viewed in FIGS. 6 and 8. Another biasing member (not shown) rotationally biases the trip member 58 such that a trip peg 62, attached to the trip member 58, is biased against the trip arm 54. As such, when the trip arm 54 rotates, due to contact with the lock pin 42, the trip member 58 is allowed to rotate as the trip peg 62 moves along a portion 64 of the trip arm 54. This rotation of the trip member 58 causes a trip pin 66 attached thereto to move from a first pin position 72 to a second pin position 74. The trip paddle 30, described above, being in biasing contact with the trip pin 66 is allowed to move as the trip pin 66 is moved. In summary, the movements of the forgoing linkages are as follows; the lock pin 42 travels through the hole 46 in the plate 50 during installation of the trip unit 18 to the breaker 14, contact of the lock pin 42 with the trip arm 54 causes the trip arm 54 to rotate, thereby allowing the trip peg 62 to move resulting in rotation of the trip member 58 and consequent movement of the trip pin 66, attached thereto, from the first pin position 72 to the second pin position 74, the trip pin 66 movement thereby permitting the trip paddle 30 to move from the first paddle position 32 to the second paddle position 34 about the paddle pivot 40. Once the trip unit 18 is assembled to the breaker 14, the breaker 14 can be closed and subsequently armed for tripping.

Referring to FIGS. 5-6 and 9-10, in addition to the breaker interlock system 10 preventing closing of the breaker when the trip unit 18 is not assembled to the breaker 14, the system 10 also prevents disassembly of the trip unit 18 from the breaker 14 while the breaker 14 is closed. This assures that the breaker 14 is not supplying current to the circuit as the trip unit 18 is removed. A movable locking lever 78 is positioned parallel to the plate 50 on a side of the plate 50 opposite a side on which the trip unit 18 is assembled. The locking lever 78 has a locking lever profile 82 therethrough with a first portion 80 of the locking lever profile 82 having a first dimension 81 that is similar in size to a dimension 83 of the hole 46 (FIG. 5) in the plate 50 such that the lock pin 42 can pass, unobstructed, through both the hole 46 and the locking lever profile 82 when the locking lever 78 is in a first profile position 86 (FIG. 10B). A second portion 90 of the locking lever profile 82 has a second dimension 84 that is smaller than a first dimension 85 of the lock pin 42 (FIG. 6) such that when the locking lever 78 is in a second profile position 94 (FIG. 10A), in which the second portion 90 is aligned with the hole 46, the lock pin 42 is not able to pass through the locking lever profile 82.

If, however, the trip unit 18 is fully assembled to the breaker 14 such that the lock pin 42 is fully positioned through both the hole 46 and the locking lever profile 82 (FIG. 4), then the locking lever 78 can be moved from the first profile position 86 to the second profile position 94. This movement is possible because of a groove 98 in the lock pin 42 (FIG. 6), which aligns with the lock lever 78 when the trip unit 18 is fully installed to the breaker 14. The groove 98 has a dimension 102 that is smaller than the second dimension 84 in the locking lever profile 82. As such, the locking lever profile 82 engages with the groove 98 of the lock pin 42 thereby locking the trip unit 18 into assembly with the breaker 14 as long as the locking lever 78 remains in the second profile position 94. This locking retention is such that no additional fasteners are required to hold the trip unit 18 in assembly with the breaker 14.

The engagement of the lock pin 42 with the locking lever profile 82 is used to assure that the trip unit 18 is not removed from the breaker 14 while the breaker is in a closed configuration. This is accomplished by preventing movement of a button 106 that is movably attached to the locking lever 78. The button 106 is pivotally connected to a transfer lever 110 that is rotatable about pivot 116. A portion 120 of the transfer lever 110 is slidably and pivotally attached to the locking lever 78. As such, when the button 106 is depressed, from a side of the breaker 14 from which the trip unit 18 is installed, rotation of the transfer lever 110 causes the locking lever 78 to move from the second profile position 94 to the first profile position 86. A biasing member (not shown) biases the locking lever 78 toward the second profile position 94 so that the button 106 remains in a normally undepressed configuration. A pair of headed standoffs 124 protrudes from the plate 50 through a pair of slotted holes 128 in the locking lever 78 to permit limited travel of the locking lever 78 while retaining the locking lever 78 adjacent to the plate 50.

Figure 11:
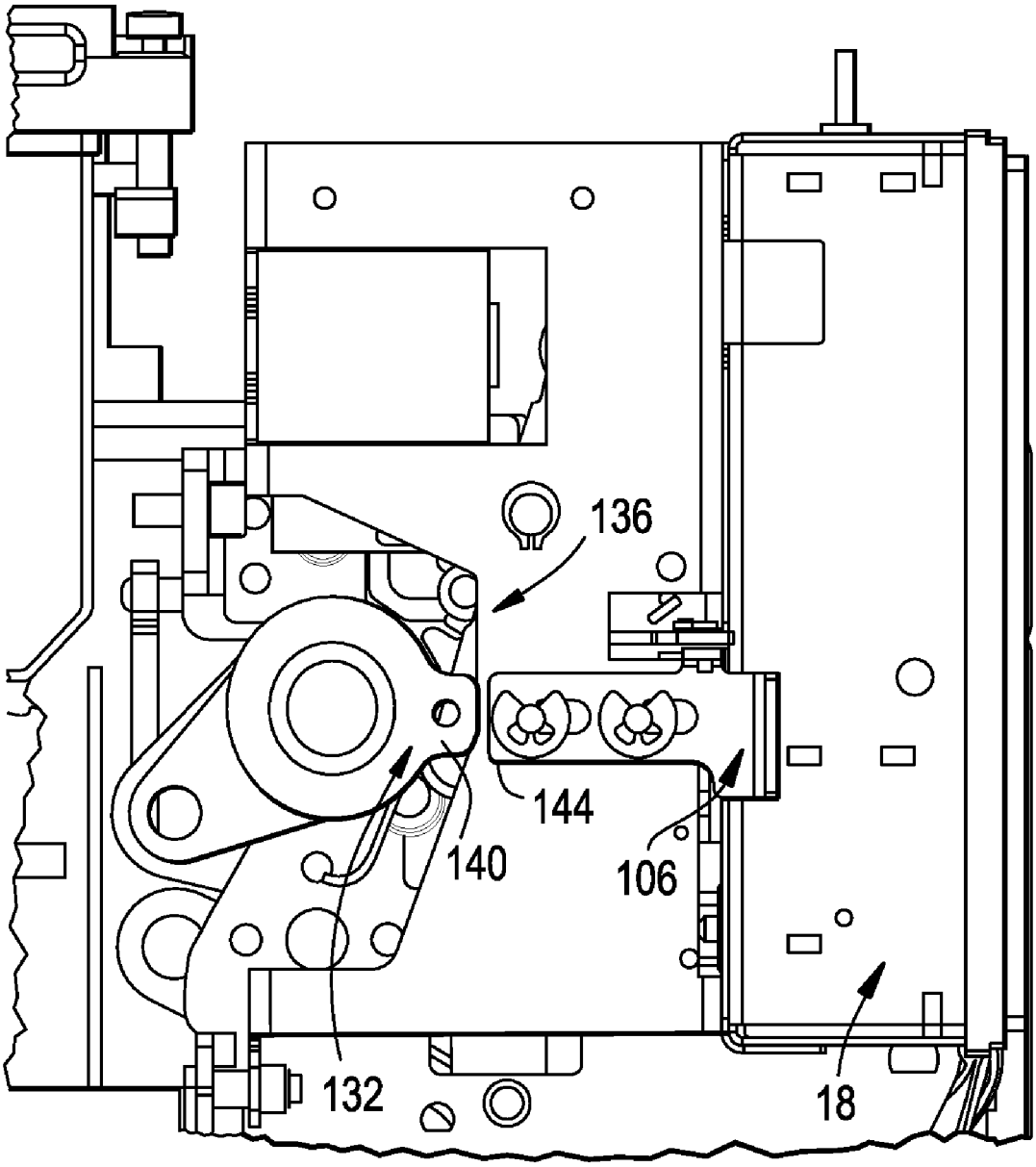
FIG. 11 depicts a partial side view of the breaker interlock system of FIG. 1 showing a button of the trip unit in a locked configuration and a breaker in a closed configuration.

Referring to FIG. 11, as mentioned above, the breaker 14 is configured to prevent disassembly of the trip unit 18 from the breaker 14 while the breaker 14 is closed. The breaker 14 incorporates a locking cam 132 to achieve this function. The locking cam 132 is configured to rotate to a locked orientation 136 in response to the breaker 14 changing from an open configuration to a closed configuration. In the locked orientation 136, the cam presents a lobe 140 in alignment with a flange 144 of the button 106 thereby preventing the button 106 from being depressed. The button 106 thereby being locked in the non-depressed configuration locks the locking lever 78 in the second profile position 94, thereby locking the trip unit 18 to the breaker 14. The locking cam 132 is further configured to rotate in response to the breaker 14 being changed from the closed configuration to the open configuration. This rotation of the locking cam 132, with the opening of the breaker 14, moves the lobe 140 to an unaligned orientation (not shown) with the flange 144, thereby allowing the button 106 to be depressed and the trip unit 18 to be disassembled from the breaker 14.

Figure 12:
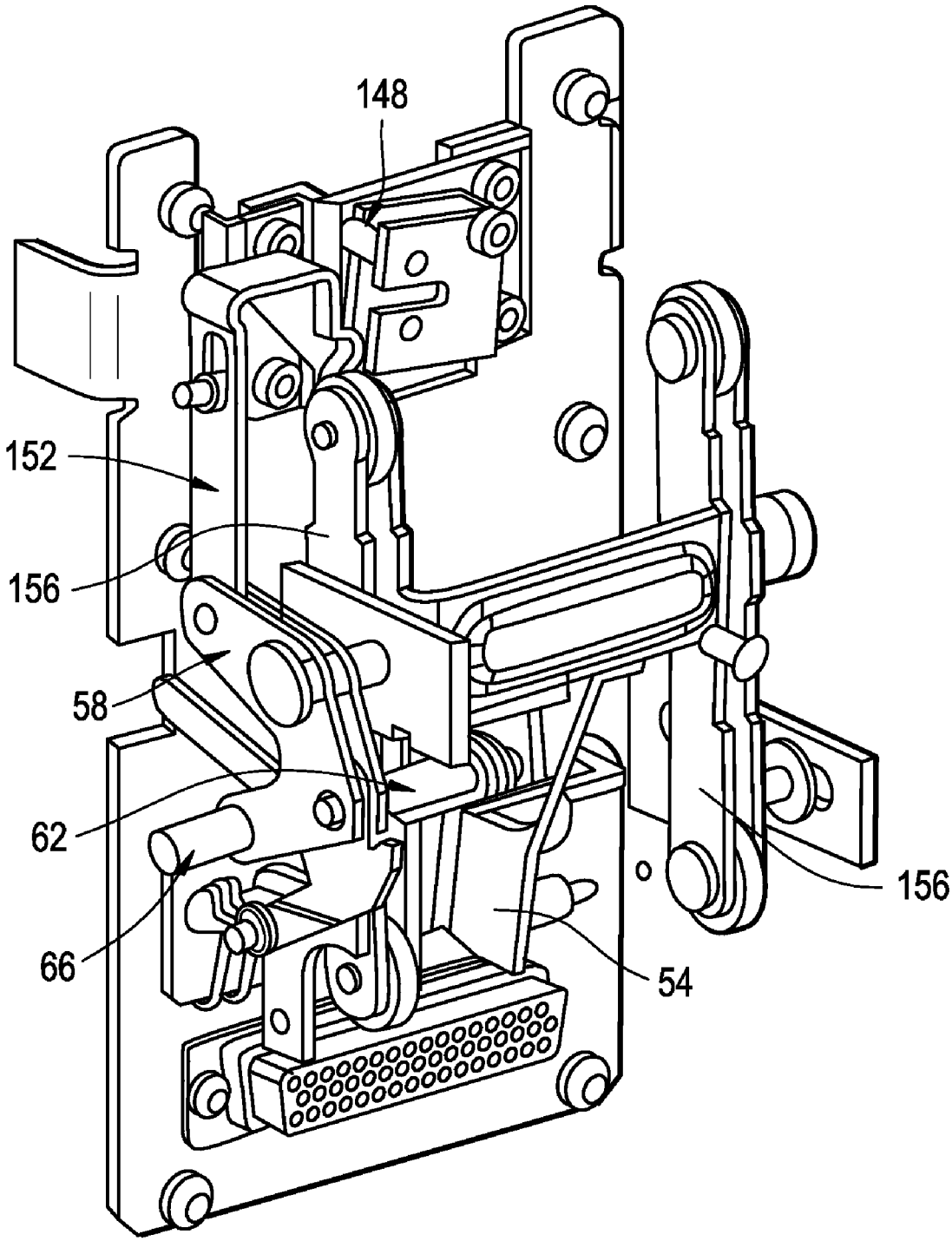
FIG. 12 depicts a partial perspective view of the breaker of FIG. 2.

Referring to FIG. 12, the breaker 14 is further configured to provide a signal to indicate that the breaker 14 has been tripped. This signal is provided, in this embodiment, by a micro switch 148. A switch activator 152 that is moved by the trip member 58 activates the micro switch 148. The trip member 58 is rotated when the breaker 14 is tripped by one of two trip links 156 each of which is in operable communication with the solenoids 22, 26.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A breaker interlock system, comprising:

an electronic trip unit for a multi-phase circuit breaker;

a multi-phase circuit breaker receptive of the electronic trip unit, the multi-phase circuit breaker being closable in response to the electronic trip unit being assembled thereto and the multi-phase circuit breaker being non-closable in response to the electronic trip unit not being assembled to the multi-phase circuit breaker, the interlock system being configured to prevent disassembly of the electronic trip unit from the multi-phase circuit breaker when the multi-phase circuit breaker is in a closed configuration, the multi-phase circuit breaker having a plurality of solenoids, each of the plurality of solenoids being in operable communication with the multi-phase circuit breaker to trip the multi-phase circuit breaker on command, a first of the plurality of solenoids being responsive to a signal from the multi-phase circuit breaker via the electronic trip unit, and a second of the plurality of solenoids being responsive to an externally supplied signal from a source other than the electronic trip unit;

wherein the multi-phase circuit breaker further includes a trip paddle, the multi-phase circuit breaker being non-closable in response to the trip paddle being in a first paddle position, and being closable in response to the trip paddle being in a second paddle position; and wherein the multi-phase circuit breaker further comprises a trip pin in operable communication with the trip paddle such that movement of the trip pin from a first pin position to a second pin position permits movement of the trip paddle from the first paddle position to the second paddle position in response to a bias applied thereto.

2. The breaker interlock system of claim 1, wherein the electronic trip unit further comprises a lock pin, and assembly of the electronic trip unit to the multi-phase circuit breaker causes the lock pin to move the trip pin from the first pin position to the second pin position.

3. The breaker interlock system of claim 2, wherein the multi-phase circuit breaker further comprises a trip arm in operable communication with the trip pin, the trip arm being movable through contact with the lock pin to thereby cause movement of the trip pin from the first pin position to the second pin position during assembly of the electronic trip unit to the multi-phase circuit breaker.

4. The breaker interlock system of claim 1, wherein the electronic trip unit further comprises a lock pin, the lock pin being configured to cause the multi-phase circuit breaker to be closable in response to the electronic trip unit being assembled to the multi-phase circuit breaker.

5. The breaker interlock system of claim 4, wherein the lock pin has a groove engagable with a locking lever profile of the multi-phase circuit breaker such that the electronic trip unit is locked into assembly with the multi-phase circuit breaker in response to the locking lever profile being engaged with the groove.

6. The breaker interlock system of claim 5, wherein the electronic trip unit is structurally fastened to the multi-phase circuit breaker through engagement of the groove with the locking lever profile.

7. The breaker interlock system of claim 5, wherein the locking lever profile is movable between a first profile position and a second profile position and the locking lever profile is engaged with the groove when the locking lever profile is in the second profile position and the electronic trip unit is assembled to the multi-phase circuit breaker, and the locking lever profile is disengaged from the groove when the locking lever profile is in the first profile position.

8. The breaker interlock system of claim 7, wherein the multi-phase circuit breaker further comprises a biasing member that biases the locking lever profile toward the second profile position.

9. The breaker interlock system of claim 7, wherein the multi-phase circuit breaker further comprises a button configured to move the locking lever profile from the second profile position to the first profile position.

10. The breaker interlock system of claim 7, wherein the multi-phase circuit breaker is configured such that locking lever profile is prevented from moving from the second profile position to the first profile position when the multi-phase circuit breaker is closed.

11. The breaker interlock system of claim 7, further comprising a latch in operable communication with the locking lever profile to prevent movement of the locking lever profile from the second profile position to the first profile position in response to the multi-phase circuit breaker being in a closed configuration.

12. A method of interlocking an electronic trip unit with a multi-phase circuit breaker, comprising:

enabling closure of the multi-phase circuit breaker in response to the electronic trip unit being assembled thereto through contact of a locking pin of the electronic trip unit with a trip paddle of the multi-phase circuit breaker;

disabling closure of the multi-phase circuit breaker in response to the electronic trip unit being disassembled from the multi-phase circuit breaker;

lockingly engaging the electronic trip unit in assembly with the multi-phase circuit breaker in response to the multi-phase circuit breaker being in a closed configuration; and enabling tripping of the multi-phase circuit breaker with a plurality of solenoids, a first of the plurality of solenoids being responsive to a signal from the multi-phase circuit breaker via the electronic trip unit, and a second of the plurality of solenoids being responsive to an externally supplied signal from a source other than the trip unit, wherein lockingly engaging the electronic trip unit includes engaging a groove in a locking pin of the electronic trip unit with a locking lever profile of the multi-phase circuit breaker.

13. The breaker interlock system of claim 1, wherein the trip paddle is biased to the second paddle position and is movable to the first paddle position in response to the electronic trip unit being assembled to the multi-phase circuit breaker.

* * * * *